US010890190B2

(12) United States Patent
Kawai et al.

(10) Patent No.: US 10,890,190 B2
(45) Date of Patent: Jan. 12, 2021

(54) MAGNETIC PUMP

(71) Applicant: IWAKI CO., LTD., Tokyo (JP)

(72) Inventors: Hiroyuki Kawai, Sayama (JP); Katsumi Kawaguchi, Sayama (JP); Toshinori Yanagihara, Sayama (JP)

(73) Assignee: IWAKI CO., LTD., Tokyo (JP)

( * ) Notice: Subject to any disclaimer, the term of this patent is extended or adjusted under 35 U.S.C. 154(b) by 600 days.

(21) Appl. No.: 15/108,424

(22) PCT Filed: Dec. 27, 2013

(86) PCT No.: PCT/JP2013/085074
§ 371 (c)(1),
(2) Date: Jun. 27, 2016

(87) PCT Pub. No.: WO2015/097851
PCT Pub. Date: Jul. 2, 2015

(65) Prior Publication Data

US 2016/0341201 A1 Nov. 24, 2016

(51) Int. Cl.
*F04D 13/02* (2006.01)
*F04D 29/043* (2006.01)
(Continued)

(52) U.S. Cl.
CPC ..... *F04D 13/024* (2013.01); *F04D 13/064* (2013.01); *F04D 13/0606* (2013.01);
(Continued)

(58) Field of Classification Search
CPC .. F04D 13/024; F04D 13/0606; F04D 13/064; F04D 29/043; F04D 29/2277;
(Continued)

(56) References Cited

U.S. PATENT DOCUMENTS 4,637,779 A * 1/1987 Sherman ..... F04D 7/045 415/143
4,722,661 A 2/1988 Mizuno
(Continued)

FOREIGN PATENT DOCUMENTS

CN 202510426 U 10/2012
DE 102011107557 A1 * 1/2013 ..... F04D 29/4273
(Continued)

OTHER PUBLICATIONS

Jul. 7, 2016 International Preliminary Report on Patentability issued in International Patent Application No. PCT/JP2013/085074.
(Continued)

*Primary Examiner* — Connor J Tremarche
(74) *Attorney, Agent, or Firm* — Oliff PLC

(57) ABSTRACT

A magnetic pump includes a front casing including: a shaft supporting body that supports a leading end of a supporting shaft; and a plurality of supporting legs that extends toward an inner wall of a suction port from the shaft supporting body, and that supports the shaft supporting body in the suction port. In the magnetic pump, a leading end of the shaft supporting body is positioned further toward the inlet side of the suction port than a connecting section between the inner wall of the suction port and the supporting leg.

6 Claims, 5 Drawing Sheets

(a) COMPARATIVE EMBODIMENT (b) FIRST EMBODIMENT

(51) Int. Cl.

| | |
|---|---|
| ***F04D 29/42*** | (2006.01) |
| ***F04D 29/66*** | (2006.01) |
| ***F04D 13/06*** | (2006.01) |
| ***F04D 29/22*** | (2006.01) |
| ***F04D 29/44*** | (2006.01) |

(52) U.S. Cl.
CPC ..... *F04D 29/043* (2013.01); *F04D 29/2277* (2013.01); *F04D 29/426* (2013.01); *F04D 29/4273* (2013.01); *F04D 29/445* (2013.01); *F04D 29/669* (2013.01); *F05D 2250/51* (2013.01)

(58) Field of Classification Search
CPC .. F04D 29/426; F04D 29/4273; F04D 29/445; F04D 29/669; F05D 2250/51
USPC ..... 417/420
See application file for complete search history.

(56) References Cited

U.S. PATENT DOCUMENTS

| | | | | |
|---|---|---|---|---|
| 5,314,302 | A | 5/1994 | Kakizawa et al. | |
| 5,399,074 | A | 3/1995 | Nose et al. | |
| 5,746,575 | A | 5/1998 | Westphal et al. | |
| 5,895,203 | A * | 4/1999 | Klein | F04D 29/20 415/122.1 |
| 6,443,710 | B1 * | 9/2002 | Tatsukami | F04D 29/0413 417/365 |
| 2012/0082543 | A1 * | 4/2012 | Choudhuri | F04D 3/00 415/211.2 |
| 2013/0115053 | A1 * | 5/2013 | Chien | F04D 29/0473 415/122.1 |

FOREIGN PATENT DOCUMENTS

| | | | |
|---|---|---|---|
| DE | 102011107557 | A1 | 1/2013 |
| GB | 2181184 | A | 4/1987 |
| JP | H06-17785 | A | 1/1994 |
| JP | H08-277795 | A | 10/1996 |
| JP | H10-201626 | A | 8/1998 |
| JP | 2001-165085 | A | 6/2001 |
| JP | 2013-096406 | A | 5/2013 |
| TW | 201320547 | A | 5/2013 |
| WO | 01/012993 | A1 | 2/2001 |

OTHER PUBLICATIONS

Dec. 14, 2016 Search Report issued in European Patent Application No. 13900453.5.

Mar. 18, 2014 International Search Report issued in International Patent Application No. PCT/JP2013/085074.

* cited by examiner

SECOND EMBODIMENT (a)

(b)

A-A' CROSS SECTION

MAGNETIC PUMP

TECHNICAL FIELD

The present invention relates to a magnetic pump that includes a magnet can and an impeller.

BACKGROUND ART

A conventionally known magnetic pump includes a front casing which forms a pump chamber, and a rear casing which forms a cylindrical space continuous with the pump chamber. A magnet can rotatably supported by a supporting shaft is disposed in the cylindrical space of the rear casing, and an impeller accommodated inside the pump chamber is coupled to the magnet can. A rotary driving unit magnetically coupled to the magnet can is disposed outside the rear casing, and the magnet can is configured to be rotated by the driving force of the rotary driving unit. When the magnet can rotates, the impeller coupled to the magnet can rotates, a transfer fluid is introduced inside the pump chamber through a cylindrical suction port formed on the front of the front casing, and the transfer fluid is discharged from a discharge port formed on a side surface of the front casing.

The supporting shaft extends to the suction port of the front casing via the pump chamber. A leading end portion of the supporting shaft is covered with a shaft supporting portion connected to the suction port, and the inner wall of the suction port and the shaft supporting portion are interconnected by means of a plurality of supporting legs.

CITATION LIST

Patent Literature

Patent Literature 1: WO 2001-012993 A

SUMMARY OF INVENTION

Technical Problem

In a conventional magnetic pump, since a plurality of supporting legs is provided, a cross section of a suction port may be small and turbulence may be generated. Therefore, there is a problem that suction characteristics and pump efficiency are deteriorated.

In view of the above problem, an object of the present invention is to provide a magnetic pump improved in suction characteristics and pump efficiency.

Solution to Problem

The present invention is a magnetic pump including: a front casing that includes a pump chamber formed inside and a cylindrical suction port through which a transfer fluid is sucked into the pump chamber; a rear casing that forms a space continuous with the pump chamber; a supporting shaft that is disposed in the space and a leading end portion of which extends to the suction port via the pump chamber; a magnet can that is disposed in the space, is rotatably supported by the supporting shaft, and is provided with a magnet along a peripheral direction of the supporting shaft; an impeller fixed to the magnet can and accommodated in the pump chamber so as to rotate integrally with the magnet can; and a rotary driving means that is magnetically coupled to the magnet via the rear casing and gives rotary driving force to the magnet, the front casing including: a shaft supporting body that supports a leading end of the supporting shaft; and a plurality of supporting legs that extends toward an inner wall of the suction port from the shaft supporting body and supports the shaft supporting body in the suction port, a leading end of the shaft supporting body being positioned further toward an inlet side of the suction port than a connecting section between the inner wall of the suction port and the supporting leg.

In the above configuration, curved portions that smoothly interconnect the plurality of supporting legs and the shaft supporting body may be provided at connecting portions between the supporting legs and the shaft supporting body, and in each of the plurality of supporting legs, curvature of the curved portion positioned at one side of a peripheral direction of the shaft supporting body may differ from curvature of the curved portion positioned at another side.

In the above configuration, the curved portion positioned at the one side in the peripheral direction of the shaft supporting body may be formed so that curvature of the curved portion changes from a central portion of the suction port toward a peripheral portion of the suction port.

In the above configuration, the plurality of supporting legs may incline by a predetermined angle with respect to a plain passing through a center axis of the shaft supporting body.

DESCRIPTION OF EMBODIMENTS

Hereinafter, a magnetic pump according to embodiments of the present invention will be described with reference to the drawings.

First Embodiment

Figure 1:
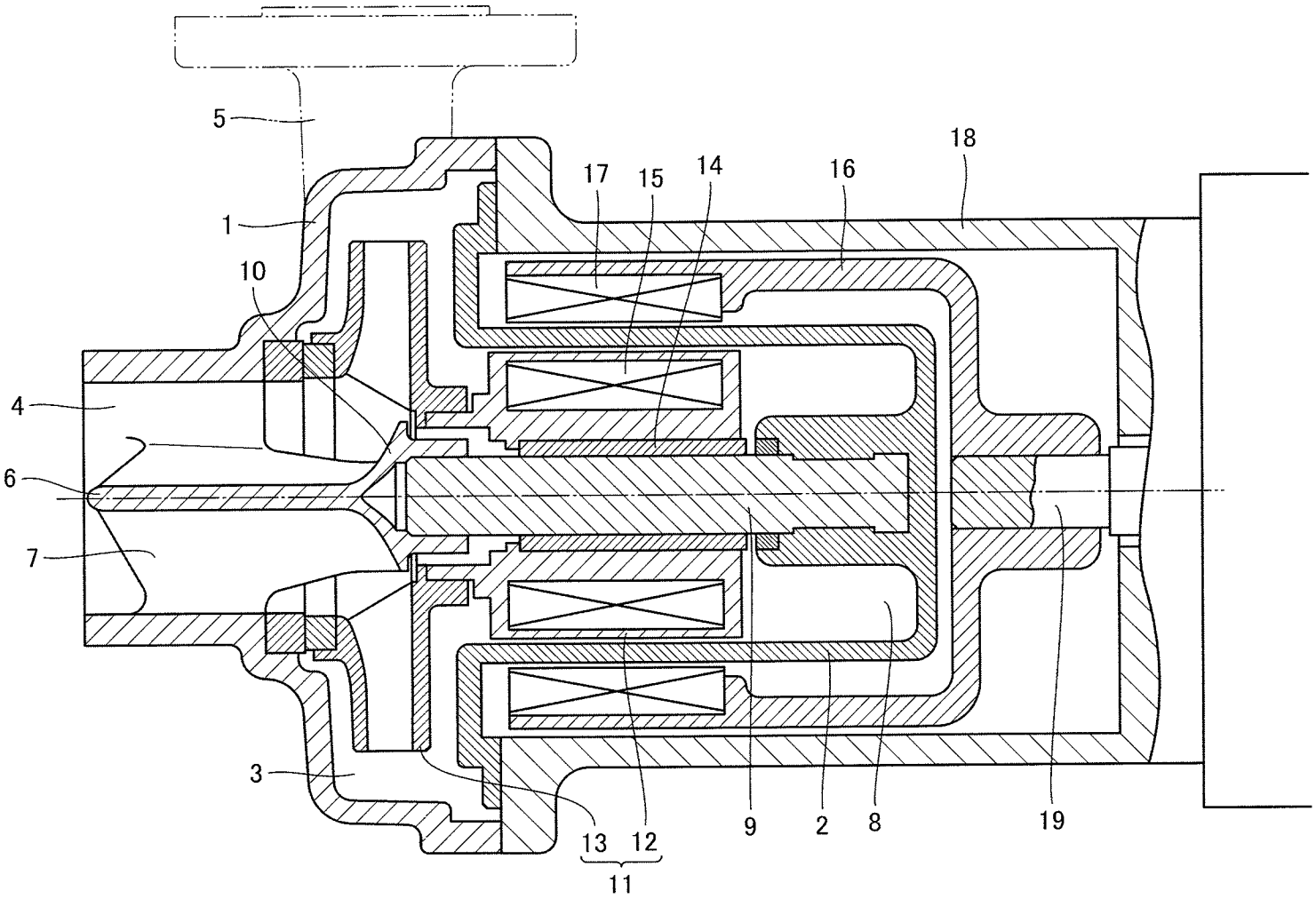
FIG. 1 is a schematic cross-sectional view of a magnetic pump according to a first embodiment.

FIG. 1 is a schematic cross-sectional view of a magnetic pump according to a first embodiment of the present invention. The magnetic pump includes a front casing 1 and a rear casing 2 connected to the front casing 1.

A pump chamber 3 is formed inside the front casing 1, and a suction port 4 and a discharge port 5 are provided on a front surface and a side surface of the front casing 1, respectively. The suction port 4 has a cylindrical shape, and a shaft supporting body 6 and supporting legs 7 are formed inside the suction port 4. A cylindrical space 8 continuous with the pump chamber 3 is formed inside the rear casing 2, and a supporting shaft 9 is disposed at the central portion of the cylindrical space 8. One end of the supporting shaft 9 is fixed to an inner wall on the rear surface side of the rear casing 2, and the other end extends to the suction port 4 via the pump chamber 3. A leading end portion 10 of the other end side of the supporting shaft 9 is covered with the shaft supporting body 6.

A rotating body 11 is rotatably supported on the supporting shaft 9. The rotating body 11 includes a magnet can 12, and an impeller 13 fixed to the magnet can 12. The magnet can 12 includes a cylindrical rotating bearing 14 slidably attached to the outside of the supporting shaft 9, and a ring-shaped driven magnet 15 disposed on the outer periphery of the rotating bearing 14. The magnet can 12 is formed into a cylindrical shape so as to be adapted to the cylindrical space 8.

At a position opposite to the driven magnet 15 of the magnet can 12, on the outside of the rear casing 2, a ring-shaped driving magnet 17 of a driving rotating body 16 is disposed so as to be magnetically coupled to the driven magnet 15. The driving rotating body 16 is accommodated in a space between the rear casing 2 and a driving body casing 18, and is driven by a motor (not illustrated) via a rotating shaft 19.

In the magnetic pump according to the present embodiment, the driving rotating body 16 is rotated by the motor via the rotating shaft 19, and thereby the driving magnet 17 rotates around the rear casing 2. Thus, the driven magnet 15 magnetically coupled to the driving magnet 17 rotates inside the rear casing, and the magnet can 12 including the rotating bearing 14 rotates around the supporting shaft 9. As a result, the impeller 13 fixed to the magnet can 12 rotates and a transfer fluid is introduced inside the pump chamber 3 through the suction port 4. The introduced transfer fluid is discharged outside via the discharge port 5.

Figure 2:
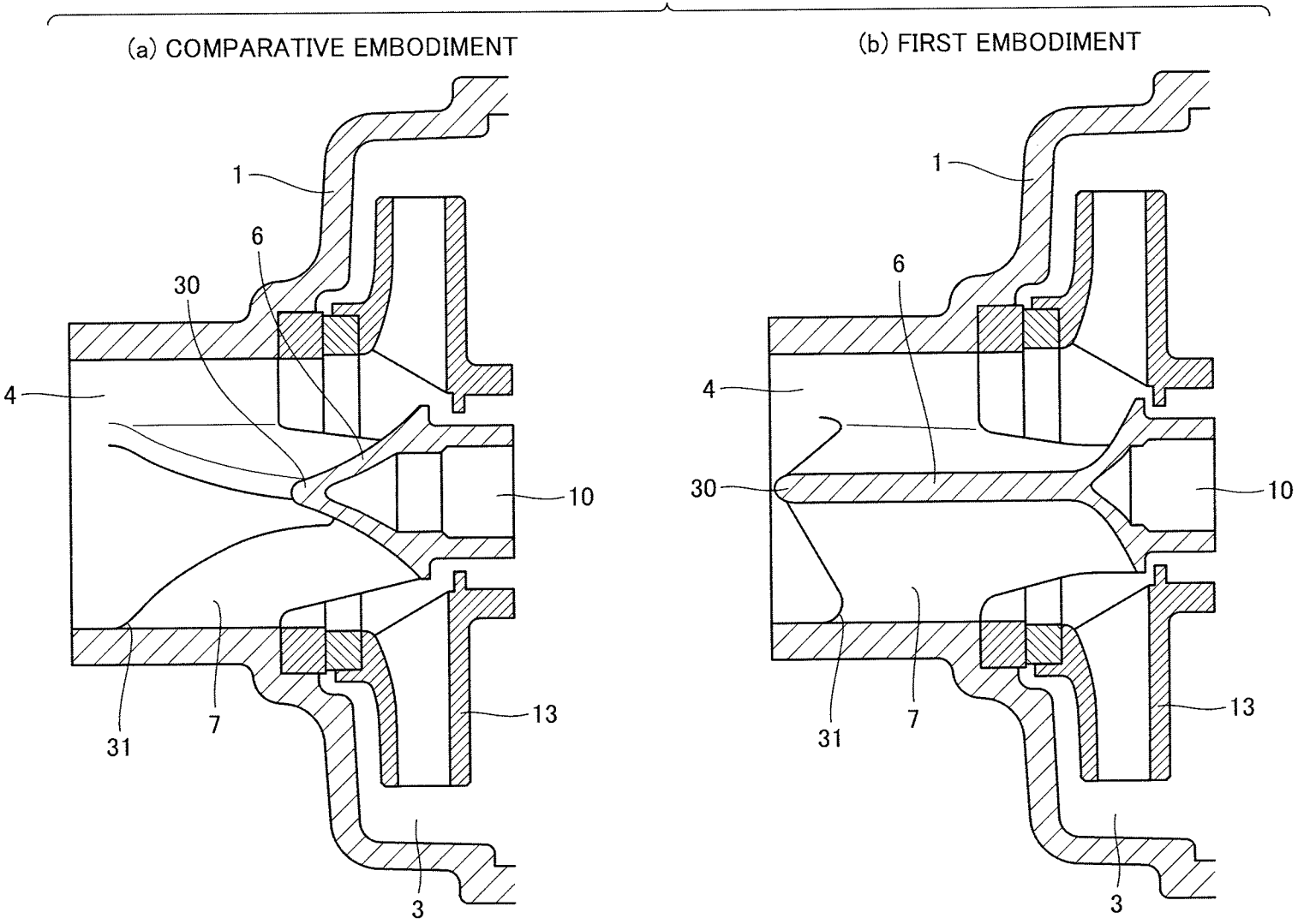
FIGS. 2(*a*) and 2(*b*) are schematic views of a suction port of the magnetic pump according to the first embodiment.

FIGS. 2 *a*) and 2(*b*) are enlarged cross-sectional views near the suction port 4 of the magnetic pump. FIG. 2(*a*) and FIG. 2(*b*) illustrate a comparative embodiment and the first embodiment, respectively.

As illustrated in FIG. 2(*a*), in the comparative embodiment, a leading end portion (see reference sign 30) of the shaft supporting body 6 is recessed toward the opposite side of the inlet side of the suction port 4 with respect to a connecting section (see reference sign 31) between the inner wall of the suction port 4 and the supporting leg 7. Therefore, the flow straightening distance of the transfer fluid introduced to the suction port 4 becomes short and turbulence is likely to be generated.

In contrast, as illustrated in FIG. 2(*b*), in the first embodiment, the leading end portion (see reference sign 30) of the shaft supporting body 6 is positioned to project toward the inlet side of the suction port 4 with respect to the connecting section (see reference sign 31) between the inner wall of the suction port 4 and the supporting leg 7. Therefore, the flow straightening distance of the transfer fluid introduced to the suction port 4 becomes longer than the flow straightening distance in the comparative embodiment, and generated turbulence is reduced.

Second Embodiment

A second embodiment is an example in which a configuration is added for imparting a whirl in advance to a transfer fluid before the transfer fluid flows into an impeller 13.

Figure 3:
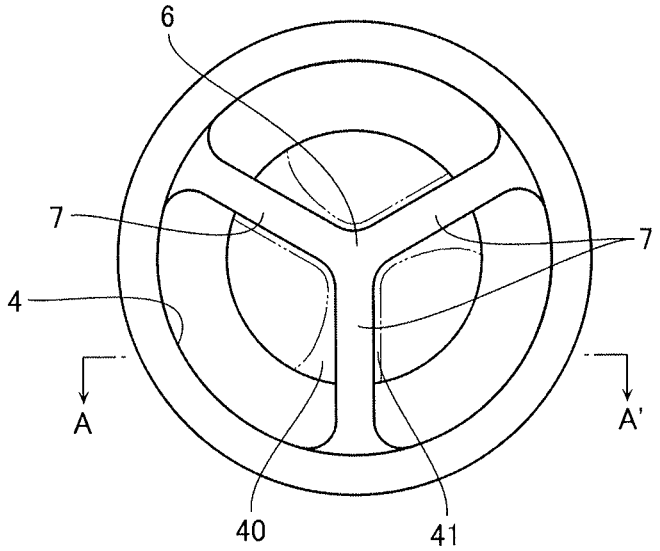
FIGS. 3(*a*) and 3(*b*) are schematic views of a suction port of a magnetic pump according to a second embodiment.
Figure 3:
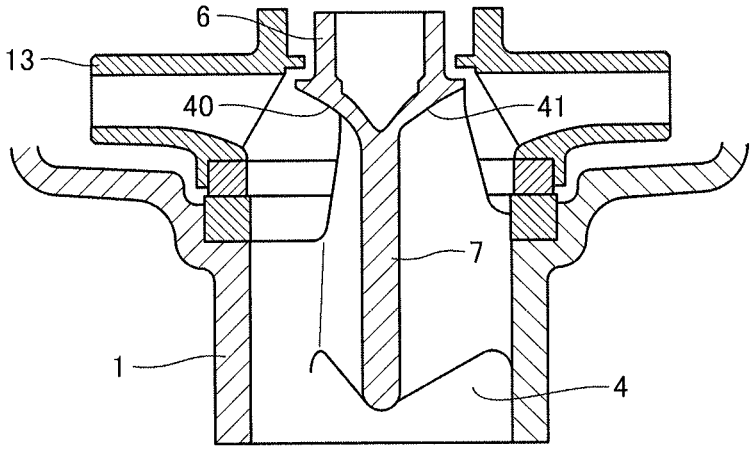

FIG. 3(*a*) is a plan view near a suction port of a magnetic pump according to the second embodiment. FIG. 3(*b*) is a cross-sectional view along A-A' line in FIG. 3(*a*). As illustrated in FIGS. 3(*a*) and 3(*b*), curved portions 40 and 41 smoothly interconnecting a supporting leg 7 and a shaft supporting body 6 are formed at a connecting section between the supporting leg 7 and the shaft supporting body 6. In each of the three supporting legs 7, the curvature of the curved portion 40 positioned at one side in the peripheral direction of the shaft supporting body 6 differs from the curvature of the curved portion 41 positioned at the other side.

Furthermore, in the second embodiment, the curved portion 40 on the one side is formed so that the curvature of the curved portion 40 becomes gradually greater as it proceeds from the shaft supporting body 6 to the inner wall of the suction port 4. In other words, the curved portion 40 on the one side is formed so that the curvature of the curved portion 40 on the one side changes from the central portion of the suction port 4 toward the peripheral portion of the suction port 4.

The shapes of the curved portions 40 and 41 described above are intended to impart a predetermined whirl in advance to the transfer fluid introduced through the suction port 4 to the impeller 13. Due to the shapes of the curved portions 40 and 41, the transfer fluid is introduced more smoothly through the suction port 4 to the impeller 13 than in the first embodiment.

Figure 5:
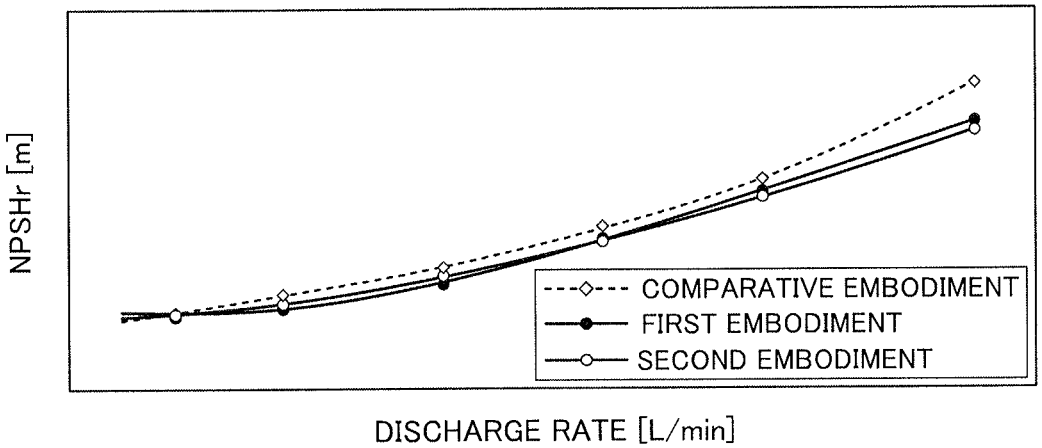
FIG. 5 is a graph illustrating suction characteristics of the magnetic pump.

FIG. 5 is a graph illustrating results obtained by comparing three embodiments, the comparative embodiment, the first embodiment, and the second embodiment with respect to the suction characteristics of the magnetic pump. Here, comparison results especially with respect to a value called NPSHr (required NPSH: required suction head) from among values called net positive suction head (NPSH: effective suction head) are illustrated. NPSHr indicates pressure of suction force for preventing problems such as noises and vibration when the transfer fluid is introduced into the pump chamber, and the smaller the value is, the more excellent the pump is evaluated to be. The abscissa axis and the ordinate axis of the graph indicate the discharge rate [L/min] of the transfer fluid and the value [m] of NPSHr, respectively.

As illustrated in FIG. 5, the value of NPSHr in the comparative embodiment is the greatest, the value in the first embodiment is the second greatest, and the value in the second embodiment is the third greatest. As described, it can be seen that the suction characteristics of the pump in the first and second embodiments are improved in comparison with the suction characteristics in the comparative embodiment. In addition, it can be seen that the suction characteristics of the pump in the second embodiment is improved in comparison with the suction characteristics in the first embodiment.

Figure 6:
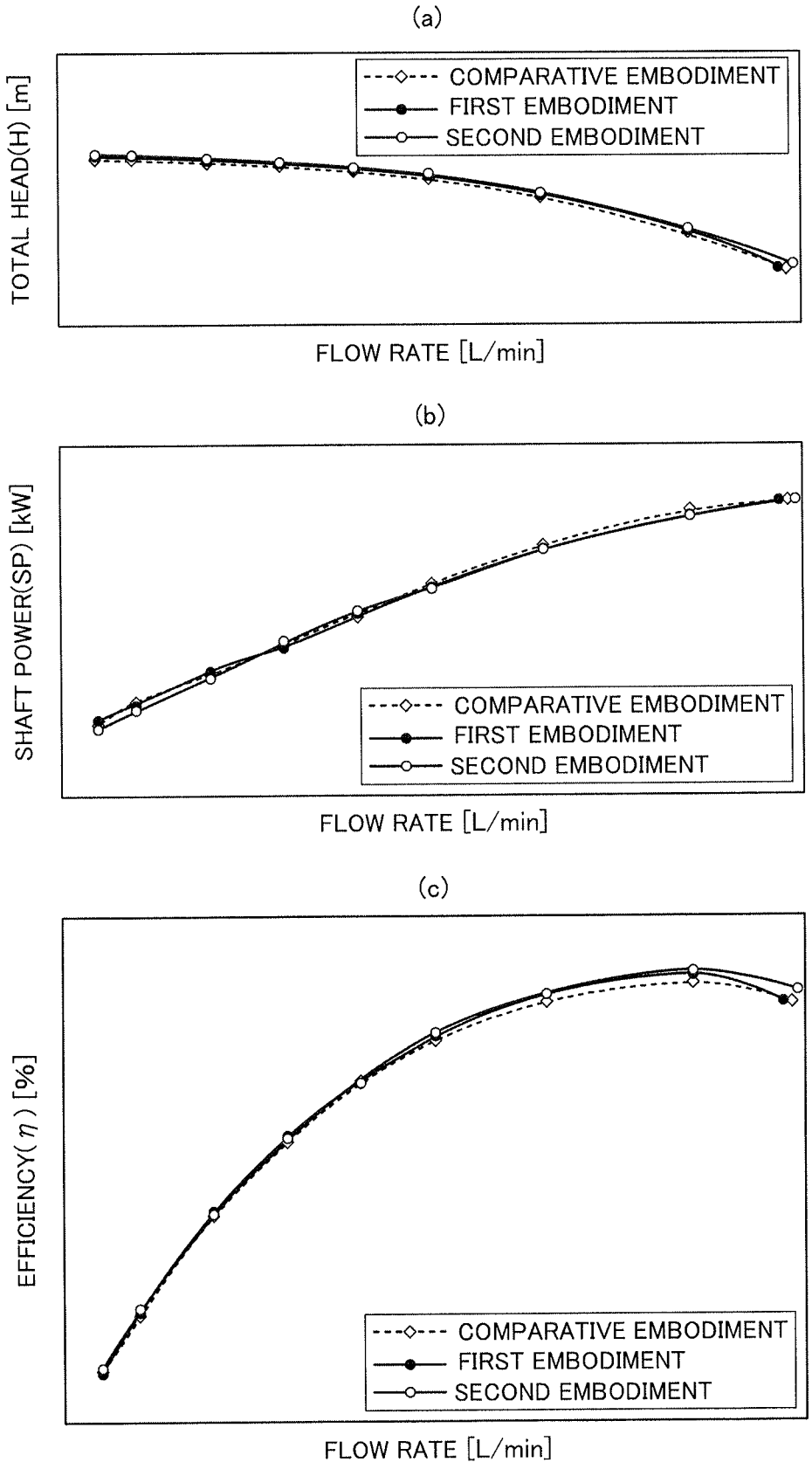
FIGS. 6(*a*) to 6(*c*) are graphs illustrating pump efficiencies of the magnetic pump.

FIGS. 6(*a*) to 6(*c*) are graphs illustrating results obtained by comparing the three embodiment, the comparative embodiment, the first embodiment, and the second embodiment with respect to pump efficiency of the magnetic pump. The abscissa axis of the graph indicates flow rate [L/min] of the transfer fluid. The ordinate axis of FIG. 6(*a*), the ordinate axis of FIG. 6(*b*), and the ordinate axis of FIG. 6(*c*) indicate total head (H) [m], shaft power (SP) [kW], and pump efficiency (η) [%], respectively.

As illustrated in FIG. 6(*a*), in an area in which the flow rate is relatively great (right half of the graph), the total head (H) in the second embodiment is the greatest, the total head (H) in the first embodiment is the second greatest, and the total head (H) in the comparative embodiment is the third greatest. In contrast, as illustrated in FIG. 6(*b*), the shaft power (SP) in the comparative embodiment is the greatest, the shaft power (SP) in the first embodiment is the second greatest, and the shaft power (SP) in the second embodiment is the third greatest. As a result, as illustrated in FIG. 6(*c*), the pump efficiency (η) in the second embodiment is the greatest, the pump efficiency (η) in the first embodiment is the second greatest, and the pump efficiency (η) in the comparative embodiment is the third greatest. As described, it can be seen that the first and second embodiments are superior also in terms of pump efficiency compared to the comparative embodiment. In addition, it can also be seen that the second embodiment is superior in terms of pump efficiency compared to the first embodiment.

In the first and second embodiments, the magnetic pump that includes the suction port 4 provided with the three supporting legs 7 has been described as an example; however, the number of supporting legs 7 is not limited to this and may be any number as long as the number is plural. In addition, in the first and second embodiments, the magnetic pump has been described as an example; however, it is possible to adopt an improvement of the suction port 4 according to the above embodiments for a pump of another type.

Third Embodiment

Figure 4:
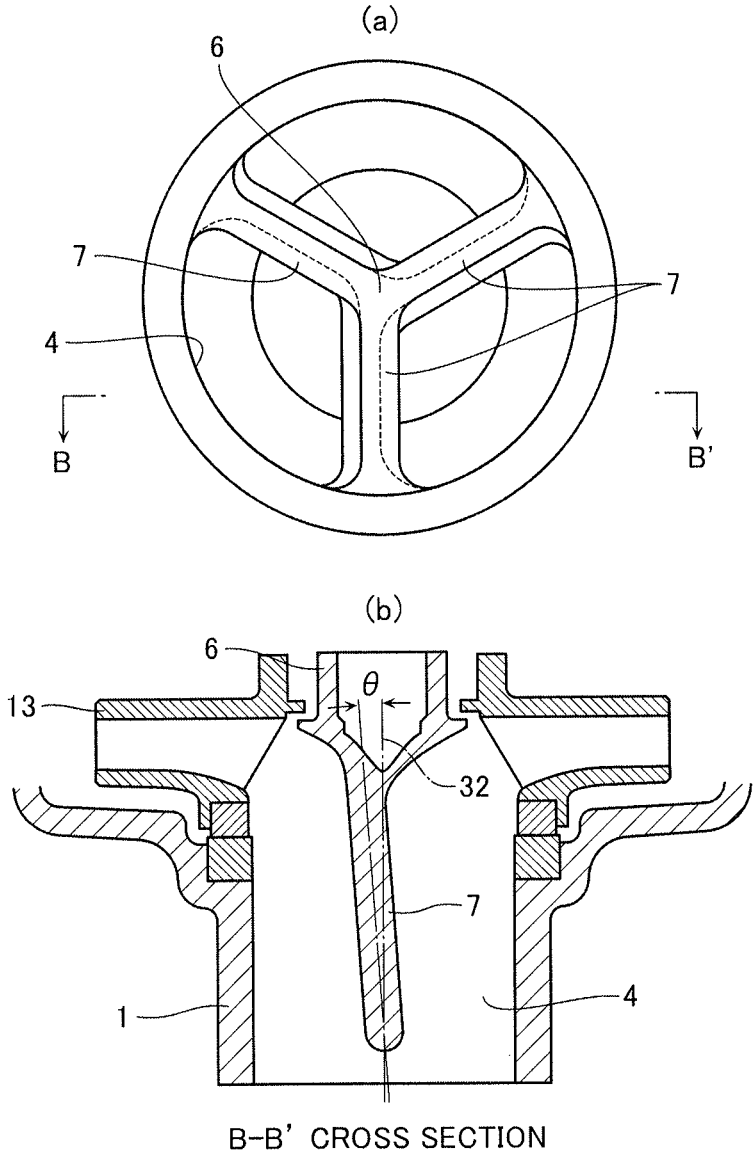
FIGS. 4(*a*) and 4(*b*) are schematic views of a suction port of a magnetic pump according to a third embodiment.

FIG. 4(*a*) is a plan view near a suction port 4, FIG. 4(*b*) is a cross-sectional view along B-B' line in FIG. 4(*a*), and both FIG. 4(*a*) and FIG. 4(*b*) correspond to a third embodiment. As illustrated in FIG. 4(*a*), three supporting legs 7 extend substantially straight from a shaft supporting body 6 positioned at the center of the suction port 4 toward the inner wall of about the suction port 4. In addition, as illustrated in FIG. 4(*b*), each supporting leg 7 is formed so as to be inclined by a predetermined angle (θ) with respect to a plane passing through the center axis (see reference sign 32) of the shaft supporting body 6. Therefore, it is possible to impart prewhirl to a transfer fluid reaching from the suction port 4 to an impeller 13.

As described, in the magnetic pump according to the third embodiment, it is possible to suppress generation of turbulence and to efficiently straighten the flow of the transfer fluid.

Other Embodiments

Some embodiments of the present invention have been described above; however, these embodiments are presented by way of examples, and are not intended to limit the scope of the invention. These novel embodiments may be implemented in various other forms, and various omissions, replacements, and changes may be made without departing from the gist of the invention. These embodiments and modifications thereof are included in the scope and gist of the invention, and are included in the scope of the invention described in the claims and equivalents thereof.

Reference Signs List

1 front casing
2 rear casing
3 pump chamber
4 suction port
5 discharge port
6 shaft supporting body
7 supporting leg
8 cylindrical space
9 supporting shaft
10 leading end portion
11 rotating body
12 magnet can
13 impeller
14 rotating bearing
15 driven magnet
16 driving rotating body
17 driving magnet
18 driving body casing
19 rotating shaft
30 leading end portion of shaft supporting body
31 connecting portion between supporting leg and suction port inner wall
32 center axis of shaft supporting body
40, 41 curved portion

The invention claimed is:

1. A magnetic pump comprising:

a front casing that includes a pump chamber formed inside and a cylindrical suction port through which a transfer fluid is sucked into the pump chamber;

a rear casing that forms a space continuous with the pump chamber;

a supporting shaft that is disposed in the space and a leading end portion of which extends to the suction port via the pump chamber;

a magnet can that is disposed in the space, is rotatably supported by the supporting shaft, and is provided with a magnet along a peripheral direction of the supporting shaft;

an impeller fixed to the magnet can and accommodated in the pump chamber so as to rotate integrally with the magnet can; and a rotary driving means that is magnetically coupled to the magnet via the rear casing and gives rotary driving force to the magnet, the front casing including:

a shaft supporting body that supports a leading end of the supporting shaft; and a plurality of supporting legs that extend from an inner wall of the suction port to the shaft supporting body and support the shaft supporting body in the suction port, wherein:

a leading end of the shaft supporting body is positioned further toward an inlet side of the suction port than a connecting section between the inner wall of the suction port and the plurality of supporting legs;

the plurality of supporting legs extend from the connecting section on the inner wall to the leading end of the shaft supporting body that is further toward the inlet side than the connecting section such that the plurality of supporting legs extend toward the inlet side from the inner wall;

the leading end of the supporting shaft is located at a position where the impeller is located in a direction in which the supporting shaft extends;

the shaft supporting body extends from the leading end of the supporting shaft to the inlet side of the suction port; and the plurality of supporting legs extend from the connecting section on the inner wall to the leading end of the supporting shaft that is further toward an opposite side to the inlet side than the connecting section, with the proviso that each of the plurality of supporting legs is a continuous element that extends from the inner wall both toward the leading end of the supporting shaft and to the leading end of the shaft supporting body.

2. The magnetic pump according to claim 1, wherein:

a plurality of curved portions that interconnect the plurality of supporting legs and the shaft supporting body are provided at connecting portions between the plurality of supporting legs and the shaft supporting body; and in each of the plurality of supporting legs, a first curvature of a first curved portion positioned at one side of a peripheral direction of the shaft supporting body differs from a second curvature of a second curved portion positioned at another side, the first and second curved portions being among the plurality of curved portions.

3. The magnetic pump according to claim 2, wherein the first curved portion positioned at the one side in the peripheral direction of the shaft supporting body is formed so that the first curvature of the first curved portion changes from a central portion of the suction port toward a peripheral portion of the suction port.

4. The magnetic pump according to claim 1, wherein each of the plurality of supporting legs is inclined by a predetermined angle with respect to a plane passing through a center axis of the shaft supporting body and an inlet side end of the supporting leg.

5. The magnetic pump according to claim 2, wherein each of the plurality of supporting legs is inclined by a predetermined angle with respect to a plane passing through a center axis of the shaft supporting body and an inlet side end of the supporting leg.

6. The magnetic pump according to claim 3, wherein each of the plurality of supporting legs is inclined by a predetermined angle with respect to a plane passing through a center axis of the shaft supporting body and an inlet side end of the supporting leg.

* * * * *